United States Patent [19]

Reeves

[11] 3,997,930

[45] Dec. 21, 1976

[54] RETRIEVING DEVICE

[76] Inventor: James C. Reeves, P.O. Box 126, Wickett, Tex. 79788

[22] Filed: Dec. 9, 1968

[21] Appl. No.: 782,160

[52] U.S. Cl. ..... 9/9

[51] Int. Cl. ..... B63b 21/52

[58] Field of Search ..... 9/9

[56] References Cited

UNITED STATES PATENTS

| | | | |
|---|---|---|---|
| 1,476,387 | 12/1923 | Atwell | 9/9 |
| 2,866,986 | 1/1959 | Stichling | 9/9 |
| 3,171,128 | 2/1965 | Shattuck | 9/9 |

*Primary Examiner*—Duane A. Reger
*Assistant Examiner*—Steven W. Weinrieb

[57] ABSTRACT

A Retrieving Device attached to an object which when lost in water will permit the object to be located by releasing an object from the device which will float onwater.

1 Claim, 3 Drawing Figures

RETRIEVING DEVICE

This invention relates to retrieving devices and more particularly to a device for recovering articles dropped into bodies of water such as rivers or lakes.

Although my invention is described here in terms of a device for recovering articles dropped into bodies of water, it is not intended to be limited to such use.

It is well known that many items used by fishermen, swimmers, and boaters are accidentally dropped into the body of water on which they are pleasuring each year only to be lost since they cannot be located. By my invention it is now possible to locate such articles in order that they can be recovered.

Accordingly, a principal object of my invention is to permit the location and recovery of articles lost in water.

Another object of my invention is to provide the article with such a retrieving device prior to its being used as intended.

Yet another object of my invention is to provide such retrieving means simply and inexpensively for articles to be employed around and upon a body of water.

Additional objects will be apparent from a study of the following disclosure and attached claims in conjunction with the drawings, wherein:

Figure 1:
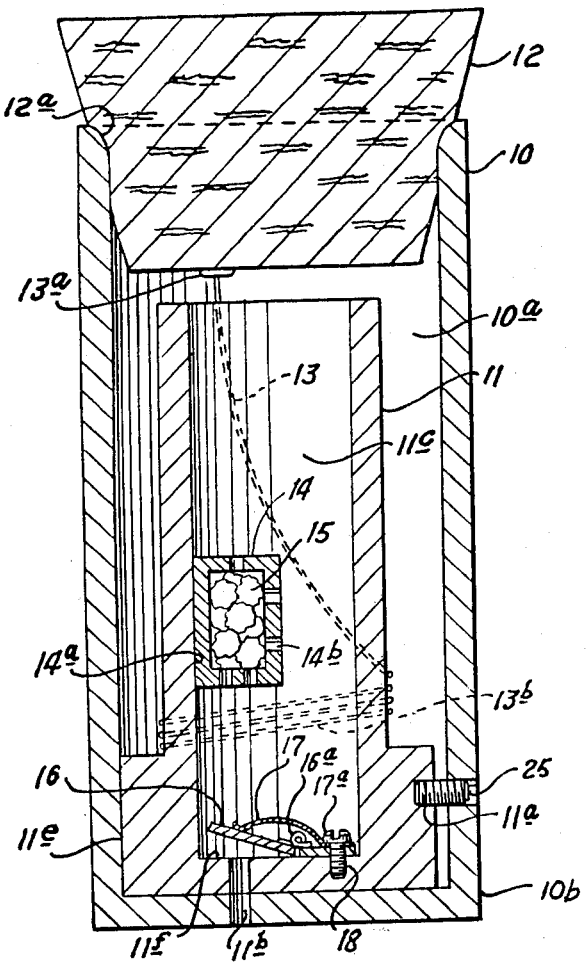
FIG. 1 is an elevational view, in section, of my invention, a Retrieving Device.

Referring to FIG. 1, spool 11 is secured in cylinder 10 by set screw 25 in the threaded area 11*a*. Spool 11 is contained in the cavity 10*a* of the cylinder 10 and also has a cavity 11*c*.

Basket 14 is secured in cavity 11*c* and has one or more perforations 14*b*. Calcium carbide particles, or other material which will rapidly produce a gas upon contact with water, are contained in basket 14.

A hole 11*b* is contained in cylinder 10 and spool 11 to permit communication between the lower exterior portion of cylinder 10 and cavity 11*c*.

Bolt 18 secures hinged flat valve 16 to the lower inside surface of spool 11 in such manner that the valve will close passageway 11*b* when the valve contacts the floor inside surface 11*f* of spool 11.

Spring 17 is secured to bolt 18 at 17*a* and contacts valve 16 in such manner as to cause valve 16 to maintain contact with surface 11*f* unless forced therefrom.

A line 13 is secured to the exterior portion of spool 11 and coiled around spool 11 as shown at 13*b*. Of course, as much line 13 as desired may be coiled around the spool 11. Line 13 is secured at 13*a* to a cork 12 or other floatable member which when inserted into cylinder 10 will close cavity 10*a* at the surface 12*a*.

This entire Retrieving Device may be employed with a fishing rod, for example, by inserting end 10*b* of the cylinder 10 into the handle of the rod by ordinary means, by attaching the cylinder 10 to a boat, a motorboat motor, or a radio, or by simply carrying it on one's person attached to an item of clothing.

Figure 3:
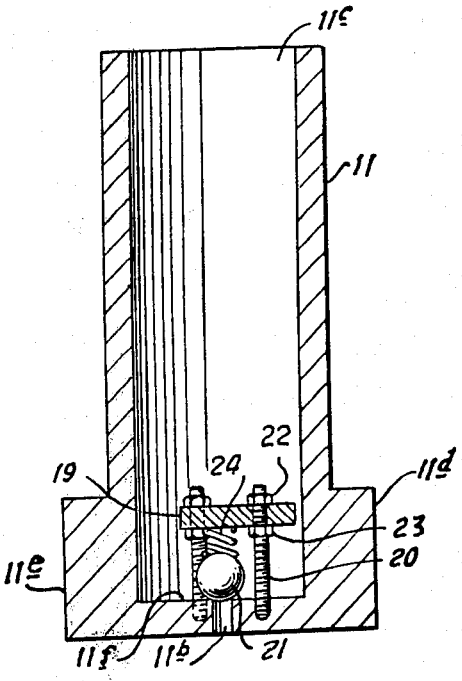
FIG. 3 is an elevational view, in section, of the alternate portion of my invention shown in FIG. 2.
Figure 2:
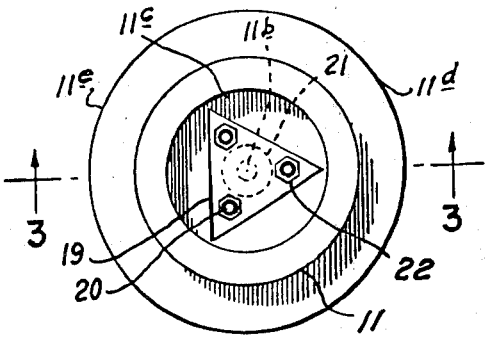
FIG. 2 is a plan view of an alternate portion of my invention.

An alternate means for closing passage-way 11*b* is shown in FIGS. 2 and 3. A plurality of bolts 20 are secured in end 11*f* of spool 11. A plate 19 is secured to bolts 20 by nuts 22 and 23 above and below, respectively, plate 19. A rigid ball 21 is contained in the space between plate 19 and surface 11*f* in such manner that it closes passage-way 11*b* when forced there against. Spring 24 interposed between ball 21 and plate 19 causes ball 21 to close passage-way 11*b* unless forced therefrom.

Of course spool 11 contains basket 14, or other similar means, as shown in FIG. 1.

The force exerted by spring 17 or spring 24 can be increased or decreased by adjusting the spring 17 as desired.

Instead of employing a cylinder 10, the cylinder could be reduced to a sleeve and be threadedly connected to surface 11*d* of spool 11. This would result in the saving of material and costs.

In operation the Retrieving Device would be attached to an object as mentioned above. Passage-way 11*b* is closed and cork 12 closes the opposite end of cylinder 10.

Now, for example, when the boater accidentally drops his radio (to which the Retrieving Device has been secured) overboard it will sink to the bottom of the body of water. When the Retrieving Device is at a predetermined depth in the water, the pressure of the water acting through passage-way 11*b* will force valve 16 or ball 21 from its closing configuration permitting water to pass through passage-way 11*b* into cavity 11*c*. Passage-way 11*b* should be rather small in order to prevent rapid flooding of cavity 11*c*. This is so because if calcium carbide is being used as the material 15, excessive water will prevent the formation of the desired acetylene gas ($C_2H_2$) and cork 12 will not be forced from the secured position shown.

When a limited amount of water comes in contact with the calcium carbide a gas is formed and will continue to form causing the pressure within cavities 10*a* and 11*c* to exceed the pressure necessary to force cork 12 from its secure position. When this is done the cork 12 will rise to the surface of the body of water causing line 13 to unroll from its position shown. Of course, this will mark the location of the lost article and it can be retrieved.

After retrieving the lost article and the retrieving device it will be necessary to dry the retrieving device, reload it with material 15 and re-assemble it as described hereinabove.

From the foregoing it is seen that by my invention I have provided a Retrieving Device for the location and recovery of articles lost in water.

It is further seen that by my invention I have provided means by which an article may be provided with such Retrieving Device prior to its being used as intended.

It is also seen that by my invention I have provided an inexpensive and simple means of retrieving articles to be employed around and upon a body of water.

It is to be understood that the form of the inventions shown and described is to be taken as a preferred embodiment of the same and that various changes in the shape, size, and arrangement of parts may be resorted to without departing from the spirit of the invention or the scope of the attached claims.

Having described my invention, what I claim and desire to secure by letters patent is:

1. A retrieving device for locating a submerged object comprising: enclosure means having an opening in each end; tubular spool means secured within said enclosure means and having openings at each end in alignment with said openings in said enclosure means; stopper means releasably secured in one end of said enclosure means and having a line secured thereto, the opposite end of said line being connected to said spool means; closure means comprising a valve maintained against said aligned openings by a spring exerting a predetermined force, secured within said spool means in such manner that the aligned openings in said spool means and said enclosure means, opposite said stopper means, remain closed until said closure means is forced therefrom; basket means secured within said spool means at a position whereby the operation of said closure means in unaffected; and gas-producing means contained within said basket means, whereby said stopper means is forced from said enclosure means by gas produced by water contacting said gas-producing material after having forced said closure means from said aligned openings and having entered said spool means.

* * * * *